United States Patent [19]

Drutchas et al.

[11] 4,259,044

[45] Mar. 31, 1981

[54] FUEL PUMP ASSEMBLY

[75] Inventors: Gilbert H. Drutchas, Birmingham; Phillip B. Spencer, Troy, both of Mich.

[73] Assignee: TRW Inc., Cleveland, Ohio

[21] Appl. No.: 39,371

[22] Filed: May 15, 1979

[51] Int. Cl.[3] ..... F01C 2/00

[52] U.S. Cl. ..... 418/82; 418/267

[58] Field of Search ..... 417/204; 418/15, 82, 418/266, 267, 268

[56] References Cited

U.S. PATENT DOCUMENTS

| | | | |
|---|---|---|---|
| 2,357,334 | 9/1944 | Kendrich | 418/267 X |
| 2,853,023 | 9/1958 | English | 418/267 X |
| 2,955,542 | 10/1960 | Gaubatz | 418/82 X |
| 3,045,648 | 7/1962 | Belau et al. | 418/82 X |
| 3,052,189 | 9/1962 | Head | 418/82 X |
| 3,797,977 | 3/1974 | Carlson | 418/267 |
| 3,953,153 | 4/1976 | Huber et al. | 417/204 |
| 4,080,124 | 3/1978 | Drutchas | 418/267 |

*Primary Examiner*—Herbert Goldstein

*Attorney, Agent, or Firm*—Yount & Tarolli

[57] ABSTRACT

A pump for pumping low viscosity fuels has a cam defining a pumping chamber bore wall. A plurality of slippers define pumping pockets located within the bore wall. The slippers are rotated through inlet arcs and through outlet arcs. A pair of orifices of predetermined diameter are located in the respective inlet arcs and communicate with each pumping pocket at a location radially inwardly of the slippers. Each orifice is circular in cross-section and has a diameter within the range of 0.067 inches to 0.076 inches. Each orifice diameter is such that pump noise restricted and the pump has a relatively high inlet vacuum.

11 Claims, 11 Drawing Figures

VACUUM
NOISE LEVEL
FUEL FLOW
0
.05
.06
.07
.08
.09
.100
.110
ORIFICE DIA.
20
19
18
17
16
15
14
13
12
11
10
VACUUM—IN Hg
85
80
75
70
65
NOISE LEVEL—DB.
300
290
280
270
260
250
240
230
220
210
200
FUEL FLOW—LBS./HR.

△ FUEL FLOW
○ NOISE LEVEL
□ VACUUM
ORIFICE DIA.
0
.05
.06
.07
.08
.09
.100
.110
VACUUM – IN Hg
23
22
21
20
19
18
17
16
15
14
13
12
NOISE LEVEL – DB.
85
80
75
70
45
FUEL FLOW – LBS./HR.
140
130
120
110
100
90
80
70
60
50
40

△ FUEL FLOW
○ NOISE LEVEL
□ VACUUM
VACUUM-IN Hg
24
23
22
21
20
19
18
17
16
15
14
13
12
NOISE LEVEL-DB
85
80
75
70
65
FUEL FLOW-LBS./HR.
100
90
80
70
60
50
40
30
20
10
0
.05
.06
.07
.08
.09
.100
.110
ORIFICE DIA.

△ FUEL FLOW
○ NOISE LEVEL
□ VACUUM
ORIFICE DIA.
0
.05
.06
.07
.08
.09
.100
.110
VACUUM – IN Hg
23
22
21
20
19
18
17
16
15
14
13
12
NOISE LEVEL – DB.
85
80
75
70
65
FUEL FLOW – LBS./HR.
150
140
130
120
110
100

FUEL PUMP ASSEMBLY

BACKGROUND AND SUMMARY OF THE INVENTION

The present invention relates to a fuel pump, and particularly to a slipper pump for pumping low viscosity fuels such as gasoline or the like to an internal combustion engine of an automotive vehicle.

Certain fuel pumps are subject to rather significant noise problems. Noise is a particular problem with fuel pumps which supply fuel to a fuel injector system. Such fuel pumps are normally mounted in association with the fuel tank of the vehicle. Thus, noise produced by the pump reacts with the sheet metal of the tank, and an unacceptable noise level results.

Also, fuel pumps which are mounted in association with the fuel tank of a vehicle are subject to cavitation. Low viscosity fuels have a tendency to vaporize, and thus bubbles form in the fuel being pumped. These bubbles affect the fuel flow rate from the pump and the vacuum level at the pump inlet. A typical solution for attempting to avoid cavitation is to attempt to completely fill the pumping pockets of the pump. This is done by providing suitable inlet porting for the pumping pockets.

In the case of slipper pumps, fuel has been directed into the expanding pockets of a slipper pump through a pair of inlet ports. These ports are located so that one port provides a major portion of the flow into the pumping pockets and a second port provides for a flow of fluid into the pumping pockets at a location under the slipper. U.S. Pat. No. 4,080,124, for example, discloses such a pump. Such a pump does provide for maximum flow into the pumping pockets. However, such port configurations also results in substantial noise and/or less than optimum inlet suction capability. The noise is believed to be created (1) due to the flow eddies within the pump between the two inlet ports and (2) due to the bursting of vapor bubbles, which may have become located in a pumping pocket, during operation of the pump.

The present invention is directed to a slipper pump for pumping low viscosity fuel and adapted to be mounted in association with the fuel tank of a vehicle. In particular, the present invention is directed to a slipper pump which has low cavitation, relatively high output flow rate and inlet vacuum, and in which the aforementioned noise is restricted. Thus, the pump of the present invention may be mounted in association with a fuel tank without creating the noise made by other pumps.

More specifically, the present invention is directed to a fuel pump of the slipper type in which, in addition to an inlet port configuration, an orifice of a predetermined size is located to communicate fuel inlet with the area beneath the slipper in the inlet arc of the pump. Specifically, it has been found that by providing an orifice which communicates the fuel inlet with the area beneath the slipper, the noises produced in the pump are restricted. Further, it has been found that through the use of such an orifice a relatively high vacuum can be maintained at the pump inlet and high flow rates can be achieved from the pump.

The particular size of the orifice is important, and the particular size may vary from pump to pump depending upon the fuel which is being pumped and the rate of volume change in the pumping pockets in the pump inlet and outlet. The concept is that by throttling the flow of fluid into the pumping pockets beneath the slipper significantly improved pump performance can be achieved, particularly if the throttling orifice is properly sized.

Orifices having a diameter falling within the range of 0.067 inches to 0.076 inches have been found to be satisfactory for slipper pumps tested. Further, it has been found through testing that an orifice diameter in general accordance with the following equation provides a slipper pump with relatively high inlet vacuum, a low noise level, and relatively high fuel flow rate. The equation is:

$$Y = -0.15066X^2 + 5.1196X + 33.165$$

where:

Y = orifice diameter in thousandths of an inch and

X = cam stroke in thousandths of an inch.

As is known, cam stroke, also referred to as cam rise, determines the amount of radial movement of a slipper during pump operation. It affects the rate of change in volume of the pumping pockets of a slipper pump.

The aforementioned formula has been derived by a computer which has been supplied test data. The formula thus is an approximation of the best orifice diameter for a pump having a given cam stroke.

DESCRIPTION OF THE DRAWINGS

Further advantages and features of the present invention will be apparent to those skilled in the art to which it relates from the following detailed description of a preferred embodiment of the present invention made with reference to the accompanying drawings in which.

DESCRIPTION OF PREFERRED EMBODIMENT

Figure 1:
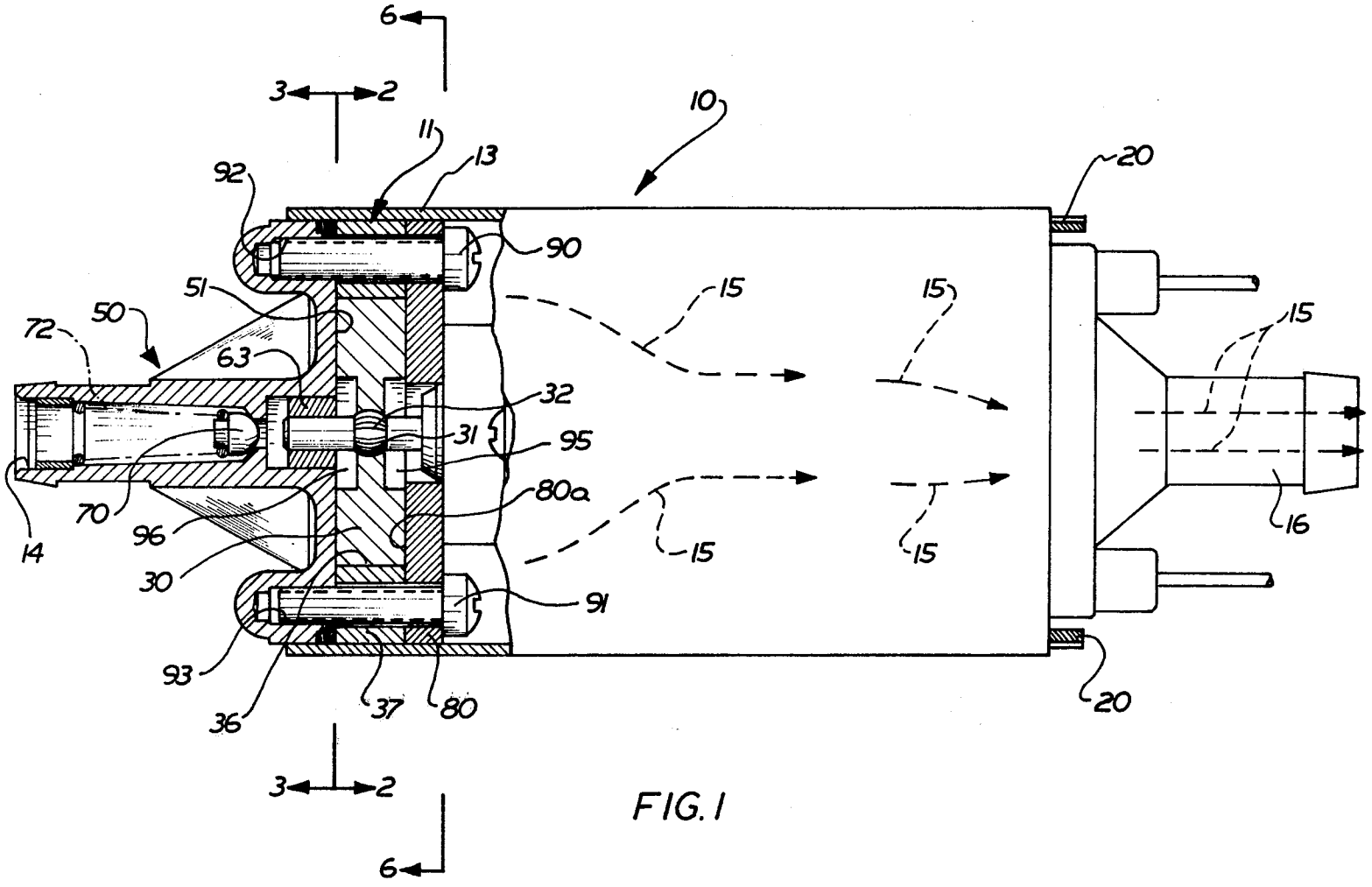
FIG. 1 is a partial sectional view of a pump embodying the present invention.

The present invention as noted above relates to a fuel pump for pumping low viscosity liquid fuels such as gasoline, alcohol, or the like for powering an internal combustion engine. In particular, the present invention is directed to a slipper pump which is constructed so as to have low cavitation, minimum of noise during the pumping operation, a relatively high fluid discharge rate, and a high vacuum level at the inlet of the pump. As representative of a preferred embodiment of the present invention, FIG. 1 illustrates a fuel pump assembly 10. The assembly 10 is adapted to be mounted in a fuel tank (not shown) and operates to supply fuel to a fuel injection system (not shown) for an internal combustion engine.

The fuel pump assembly 10 includes a fuel pump 11 and a motor assembly for driving the fuel pump 11. The motor assembly may be of any conventional construction and does not form a part of the present invention and thus is not illustrated in the drawings. The pump 11 and the motor are mounted in a housing or sleeve 13. The pump has an inlet 14 which is in communication with a suitable supply of fuel, and the discharge from the pump, as illustrated by the arrows 15 in FIG. 1, is directed through the motor and through an outlet 16. The outlet 16, as shown in FIG. 1, is located at the right end of the pump and motor assembly 10 and is coaxial with the inlet 14.

The pump 11 and the motor are mounted in a stacked relationship and are retained in the sleeve 13 by crimped portions 20 of the sleeve 13 located at each end of the sleeve. Only a few of the crimped portions 20 at the right end of the sleeve 13 are shown in FIG. 1. The crimped portions 20 are circumferentially spaced around the periphery of the sleeve 13 at the opposite ends of the sleeve 13.

As noted hereinabove, the present invention is directed to the pump assembly 11. The pump assembly 11 is a slipper type pump. Specifically, the pump assembly 11 includes a rotor 30 which has an internally splined central opening 31 therethrough. The splined opening 31 receives a splined output shaft 32 of the motor. Thus, the motor when energized rotates the rotor 30.

Figure 2:
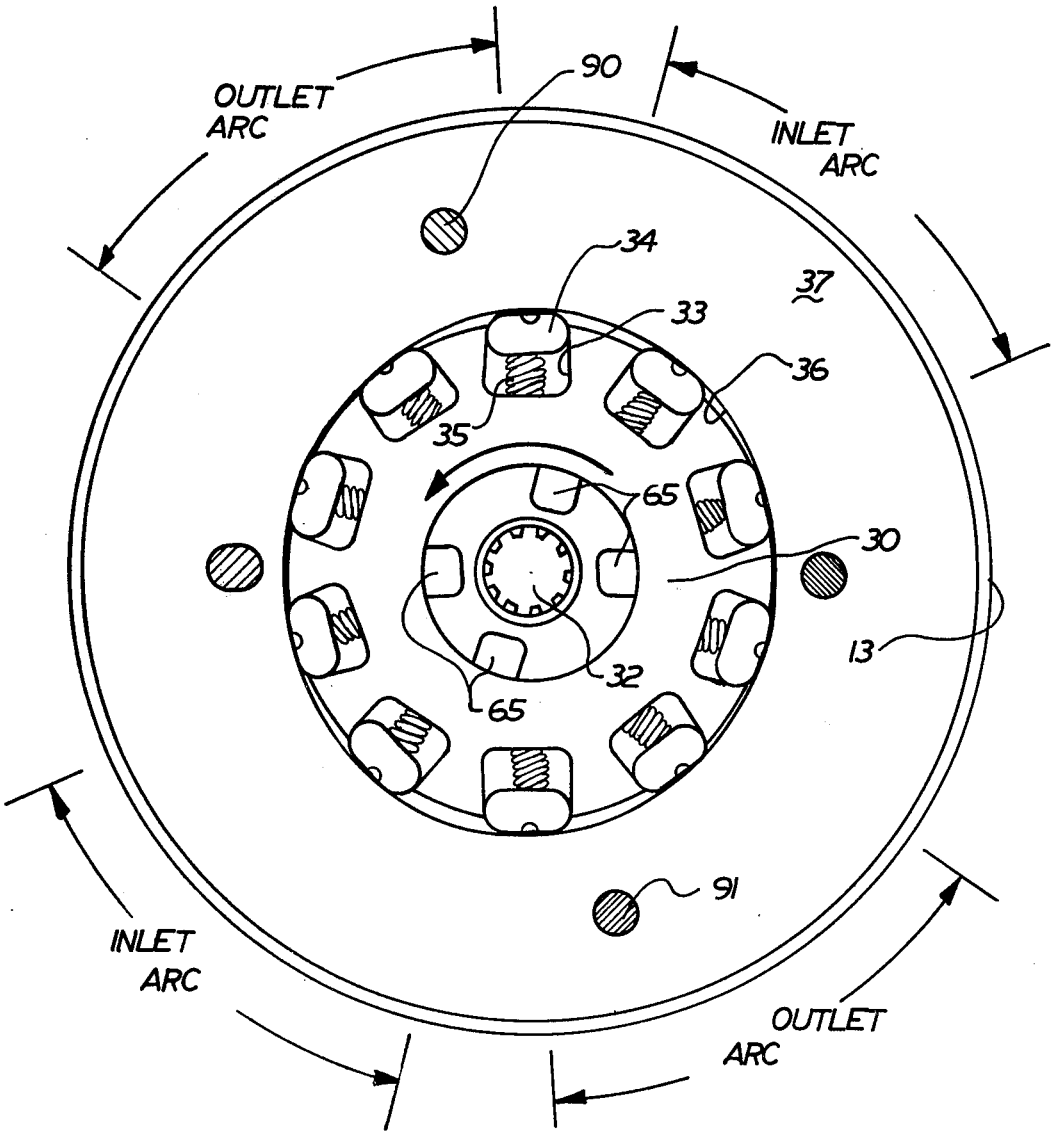
FIG. 2 is a sectional view of the pump shown in FIG. 1 taken approximately along the line 2—2 thereof.

The rotor 30 has a plurality of slots 33 (see FIG. 2) located in its outer periphery. Specifically, there are ten slots 33. Each of the slots 33 contains a slipper 34. Each slipper 34 is biased outwardly by a spring 35. The slippers 34 are biased outwardly into engagement with a cam bore 36 of a cam 37. The cam 37, of course, encircles the rotor 30. The cam bore 36 is contoured so as to provide for pumping of fluid as the rotor rotates and the slippers move around the cam bore.

Specifically, the cam bore 36 has two areas of increasing radii which are inlet arcs (so labelled on the drawings) and two areas of decreasing radii labelled on the drawings as outlet arcs. The pump illustrated in the drawings is a two-stroke pump, i.e., upon one revolution of the rotor 30 a particular pumping pocket will expand and contract twice, thus providing two pumping impulses.

The specific construction of the cam bore 36 and sizes of the various arcs defined thereby correspond to the pump shown in U.S. Pat. No. 4,080,124 and the description in that patent is incorporated herein by reference. A copy of that patent is attached. Also, the specific slipper configuration is in accordance with U.S. Pat. No. 3,797,977, and the description of that patent is incorporated herein by reference. A copy of that patent is attached.

The pump 11 on the left side thereof, as shown in FIG. 1, includes an end cap assembly generally designated 50. The end cap assembly 50 has a surface 51 which lies in sealing abutment with the side surface of the rotor 30 and cam 37. Also, as the slippers rotate with the rotor 30, one of the two ends thereof slides in sealing engagement with the surface 51.

Figure 3:
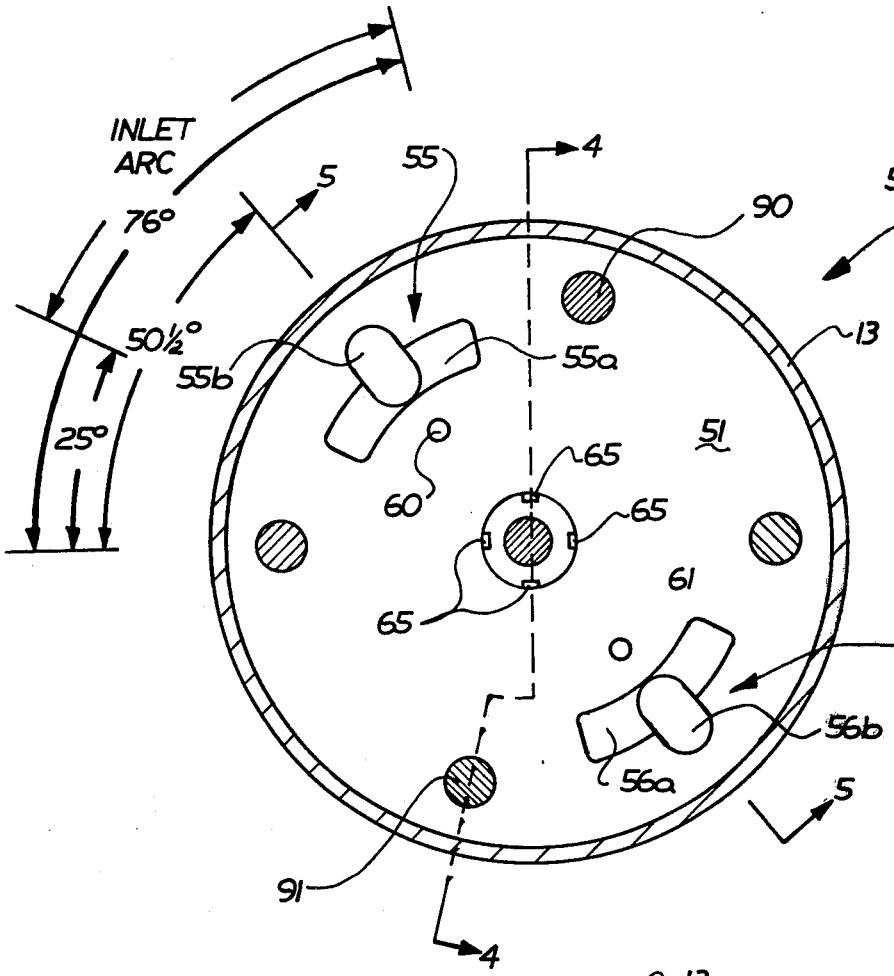
FIG. 3 is a view of the pump of FIG. 1 taken approximately along the line 3—3 thereof.
Figure 5:
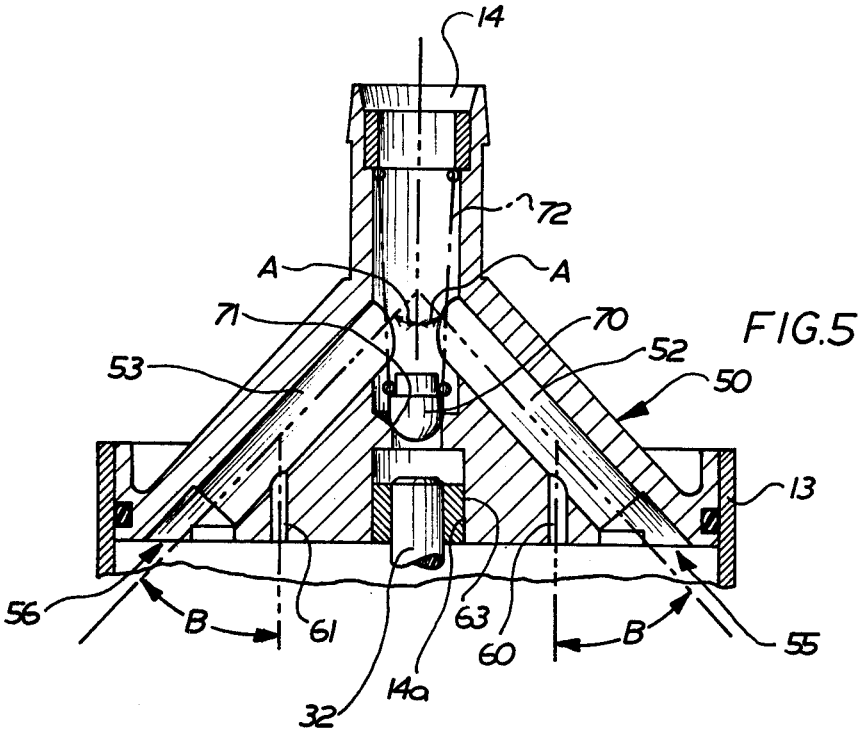
FIG. 5 is a further sectional view of the portion of the pump of FIG. 1 taken approximately along the line 5—5 of FIG. 3.

The end cap assembly 50 contains the inlet 14 for the pump. The inlet 14 communicates with a suitable supply of fuel. The inlet 14 comprises a passage extending centrally of the end cap assembly 50 and which communicates with a pair of passages 52, 53 (see FIG. 5) in the end cap assembly 50. The passages 52, 53 extend generally radially outwardly and angularly relative to the central passage 14 toward the surface 51. These passages 52, 53 communicate inlet fluid to arcuate inlet port configurations 55, 56, respectively, formed in the surface 51 as shown in FIG. 3. The inlet port configurations 55, 56 include an arcuate portion **55*a*, 56*a*, respectively, (see FIG. 3) and a radially extending portion 55*b*, 56*b*, respectively. The inlet port configurations 55, 56 lie within the respective inlet arcs defined by the cam bore 36**.

Also, in accordance with the present invention, orifices in the form of axially extending passages 60, 61 communicate with the passage 52, 53 and with the pumping pockets defined between adjacent slippers 34, the rotor periphery and the cam bore 36. These orifices 60, 61 are located so as to communicate inlet with the underside of the slippers which are located in the inlet arc of the pump. The orifices 60, 61 are of uniform diameter throughout their extent. Further, the axes of the orifices are parallel with the axis of inlet passage 14. Thus, the acute angle A between the axis of the inlet passage 14 and the axis of passages 52, 53 equals the acute angle B between the axis of orifices 60, 61 and the passages 52, 53, respectively. Thus, the inlet flow into the pumping pockets does not encounter a 90° change in flow direction at any one intersection of the inlet flow passages.

The particular size of the orifices 60, 61 is important to the present invention. The particular size of the orifices is exaggerated in the drawings and will be described hereinbelow. However, it should be apparent from the description above that as the pumping pockets move through the inlet arc, the pumping pockets increase in volume, thus decrease in pressure and create a vacuum at the inlet 14 to draw fluid into the pumping pockets.

Figure 4:
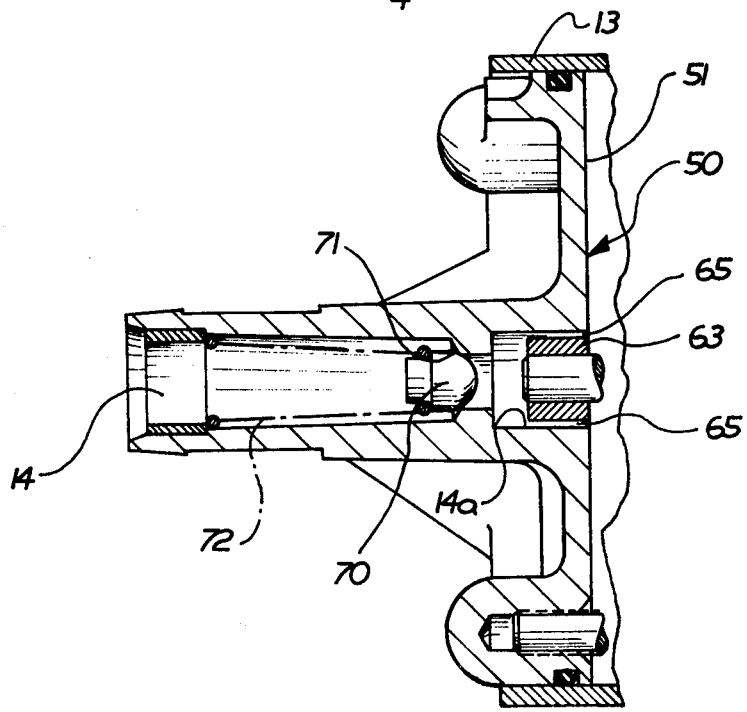
FIG. 4 is a sectional view of a portion of the pump of FIG. 1 taken approximately along the line 4—4 of FIG. 3.

The end cap assembly 50 has at its end adjacent the rotor 30 a passage portion **14*a* which receives a bearing 63. The bearing 63 receives and supports the outer end of the drive shaft 32. The bearing 63, as best shown in FIGS. 3 and 4, has a plurality of passages 65 extending axially between the bearing 63 and the body of the end cap assembly 50. The passages 65 communicate discharge pressure, as will be apparent from the description hereinbelow, to the pump inlet 14**.

Located in the pump inlet 14 is a relief valve 70 (see FIGS. 1 and 4) which is biased into sealing engagement with a valve seat 71 by a spring 72. The valve 70 will open when the pressure on the right side of the valve as shown in FIG. 4 becomes high enough. The valve 70 thus provides pressure relief in the event that discharge pressure communicated to the valve 70 by passages 65 becomes extremely high. Specifically, the valve 70 will vent the high pressure discharge from the discharge side of the pump to the inlet 14 and thereby relieve any excessive pressure on the discharge side of the pump.

As described hereinabove, as the rotor 30 rotates the slippers which define the pumping pockets rotate and the volume of the pumping pockets varies as the slippers rotate. Specifically, when the slippers rotate through the inlet arc, the pumping pockets increase in size and fluid is drawn from the inlet into the pumping pockets. As the slippers move through the outlet arc, which is decreasing in radius, the volume of the pumping pockets decrease and fluid is forced from the pumping pockets through the outlet of the pump 11. As is known, the slippers 34 as they rotate with the rotor 30 follow the cam bore 36 and rock in the slot in which they are received. However, the trailing edge of the slippers are maintained in sealing contact with the surfaces of the rotor defining the slot in which the respective slippers are located and which push the slippers. Thus, the pumping pocket between slippers is maintained integral during such slipper movement. Further, it should be clear that the area radially inward of a slipper (underside of the slipper) forms a part of the pumping pocket and is in fluid communication with the remainder of the pumping pocket due to clearance between the slippers 34 and the leading surface of the slots 33 in which the respective slippers are located.

Figure 6:
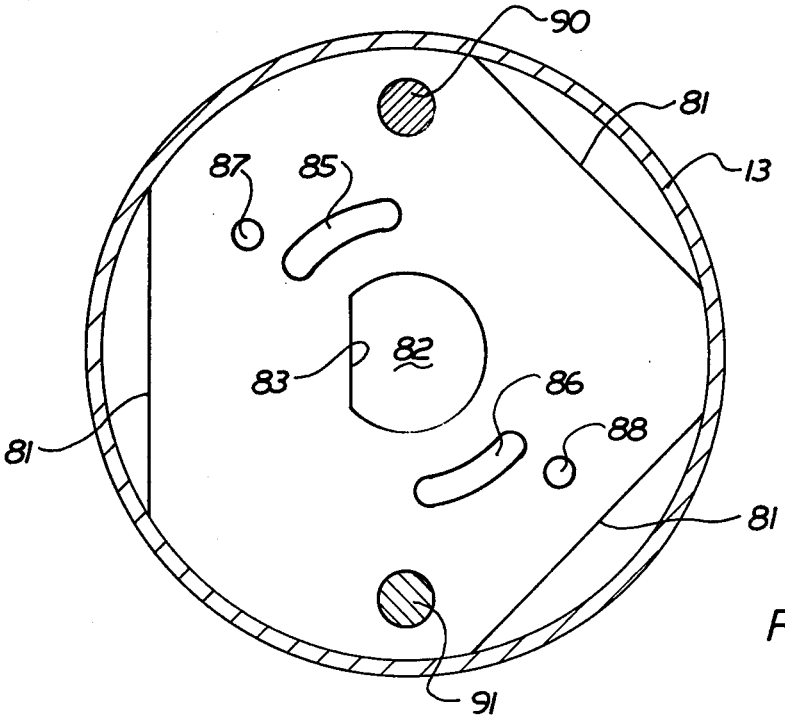
FIG. 6 is a view of the pump of FIG. 1 taken approximately along the line 6—6 of FIG. 1.

The discharge from the pump 11 is through a plate designated 80 and best shown in FIG. 6. The plate 80 has a surface 80*a* which sealingly abuts the cam 37 and rotor 30. One of the ends of the slippers 34 run in sealing engagement with the surface 80*a* as they rotate with the rotor 30. The outer periphery of the plate 80 fits snugly within the sleeve 13 and is trimmed at three spaced locations, providing three flats designated 81 thereon. The reason for trimming of the plate is for purposes of reduction in weight. The plate 80 has a central opening 82 therethrough. The central opening has a flat 83 for receiving a portion of the motor assembly (not shown) to assist in supporting the motor assembly and transmitting forces that are applied thereto to the sleeve 13.

Further, the plate 80 has diametrically located arcuate outlet ports 85, 86. The outlet ports 85, 86 are located in the respective outlet arcs defined by the cam bore 36. Also located in the respective outlet arcs are a pair of circular openings 87, 88. The outlet ports 85, 86 provide a discharge from the area below the slippers whereas the openings 87, 88 provide a discharge from the area above the slippers. The openings 87, 88 and the outlet ports 85, 86 are located so as to discharge the fluid pumped by the pump into the motor assembly through which the fluid flows to the outlet 16.

The various parts of the pump 11 are secured together by a pair of screws 90, 91. The screws 90, 91 extend through aligned openings in the discharge plate 80 and cam 37 and are threaded into tapped openings 92, 93, respectively, in the body of the end cap assembly 50. The screws 90, 91 secure the parts together to minimize the possibility of leakage.

In the event discharge pressure builds up on the discharge side of the pump, that pressure will be communicated to a central chamber 95 (see FIG. 1). The pressure will be communicated through the splined connection between the motor output shaft and rotor 30 to a chamber 96. Chambers 95, 96 are located on opposite sides of the rotor 30. The pressure is then communicated to valve 70 by the passages 65.

As noted hereinabove, the diameter of orifices 60, 61 are important to the present invention. Specifically, the orifices 60, 61 are sized so as to have the pump 11 maintain a relatively high level of vacuum at the pump inlet 14 and provide for a relatively high output flow from the pump. Further the orifices 60 and 61 are sized so that the amount of noise created in the pump by flow eddies and vapor bubble bursts is minimized.

In accordance with the present invention, the orifices 60, 61 are sized so as to provide the most effective slipper pump operation with a minimum of noise. The graphs shown in FIGS. 7–10 illustrate different operating characteristics of various pumps and show how the operating characteristics of a slipper pump varies as the orifice diameter varies. Each graph represents one pump. The pumps of FIGS. 7–10 were of identical construction except for cam stroke and orifice diameter.

Figure 7:
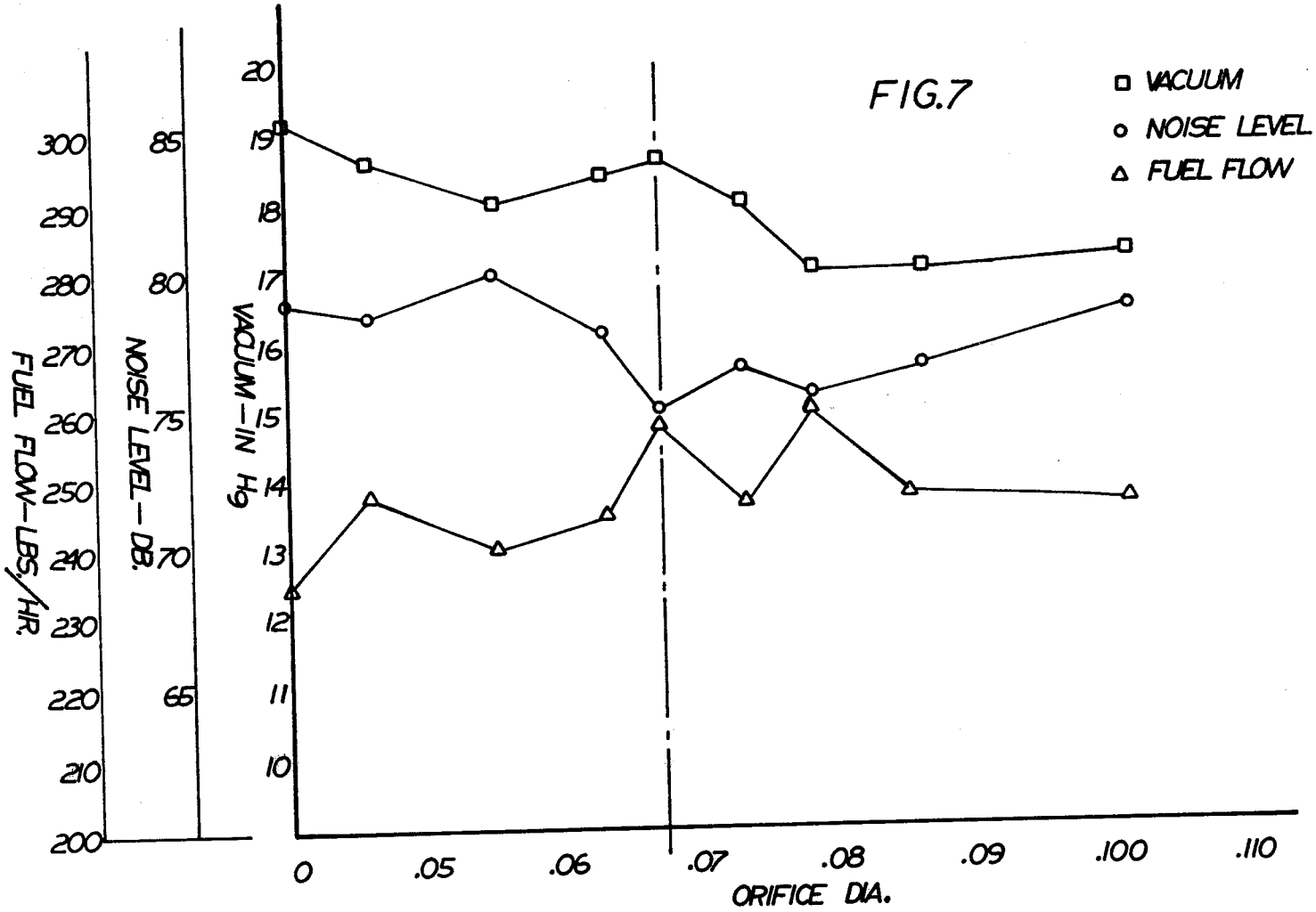
FIGS. 7, 8, 9 and 10 are graphs which illustrate typical pump characteristics and illustrate the criticality of the size of an orifice in the pump inlet to the pump operating characteristics.

As shown in FIG. 7, the noise level of the pump tends to decrease as the orifice diameter increases up to a point (0.067 inch diameter) and then the noise level increases as the orifice diameter increases beyond 0.067 inches. The outlet flow tends to increase as the size of the orifice increases to a point (0.067 inch orifice diameter) and then tends to remain lower or about the same as at a 0.067 inch orifice as the orifice diameter increases from that point. Further, the inlet vacuum level at 0.067 inch orifice diameter is relatively high. Accordingly, for the pump tested in FIG. 7, the best orifice diameter is 0.067 inches. As is clear from FIG. 7, the fuel flow rate is at a maximum at 0.067 inch orifice diameter, the noise level is at a minimum and the vacuum in the inlet to the pump is relatively high.

Figure 8:
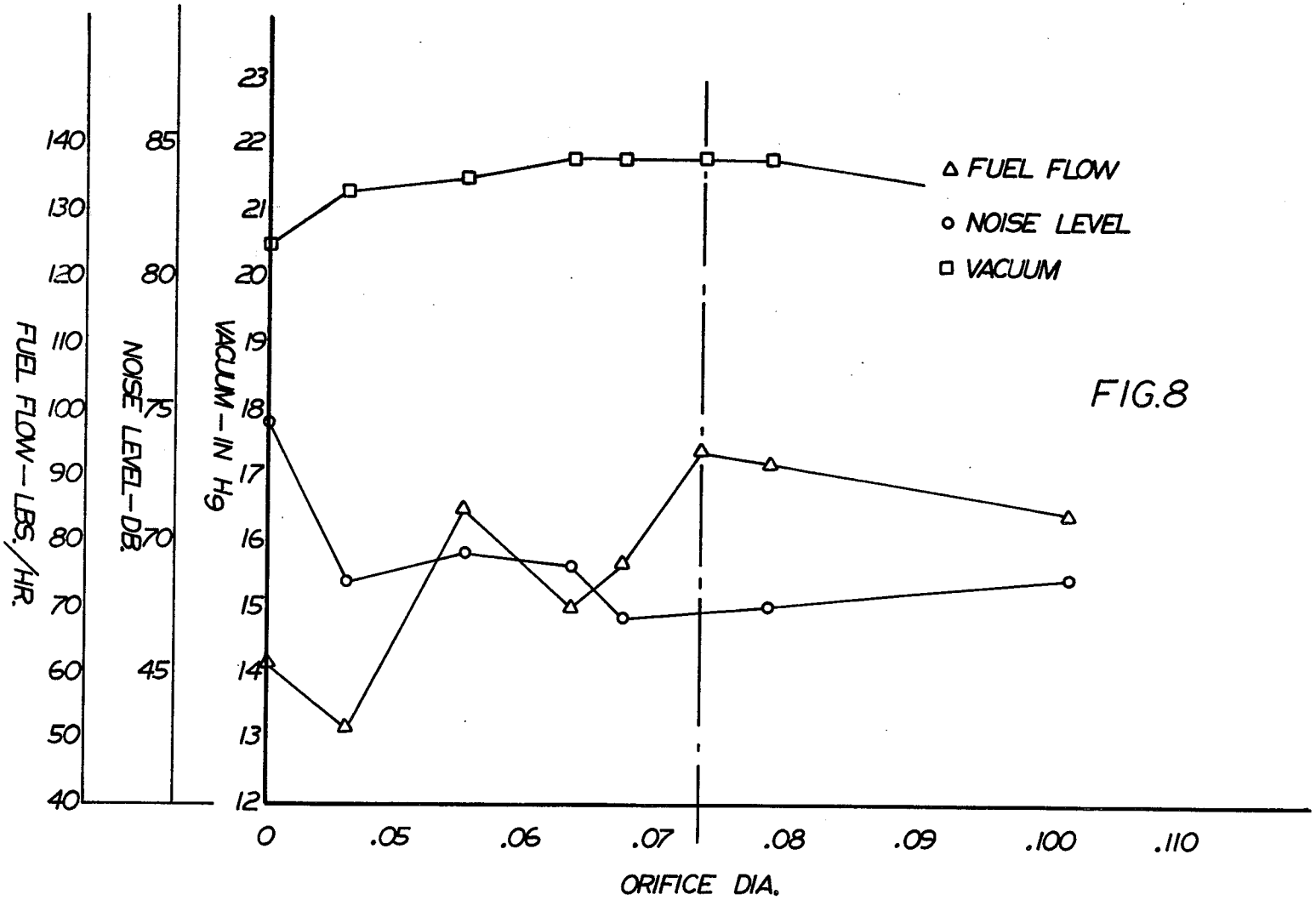

FIG. 8 is a curve of a fuel pump similar to the pump of FIG. 7 but having a different cam stroke than the pump of FIG. 7. As shown in FIG. 8, the best fuel flow rate occurs with an orifice diameter of 0.073 inches. Also, the maximum vacuum in the inlet of the pump is provided at an orifice diameter of 0.073 inches. Also, with an orifice diameter of 0.073 inches, the noise level of the pump is almost at its minimum. Accordingly, for the pump having the cam stroke of the pump tested in accordance with FIG. 8, the orifice size should be 0.073 inches.

Figure 9:
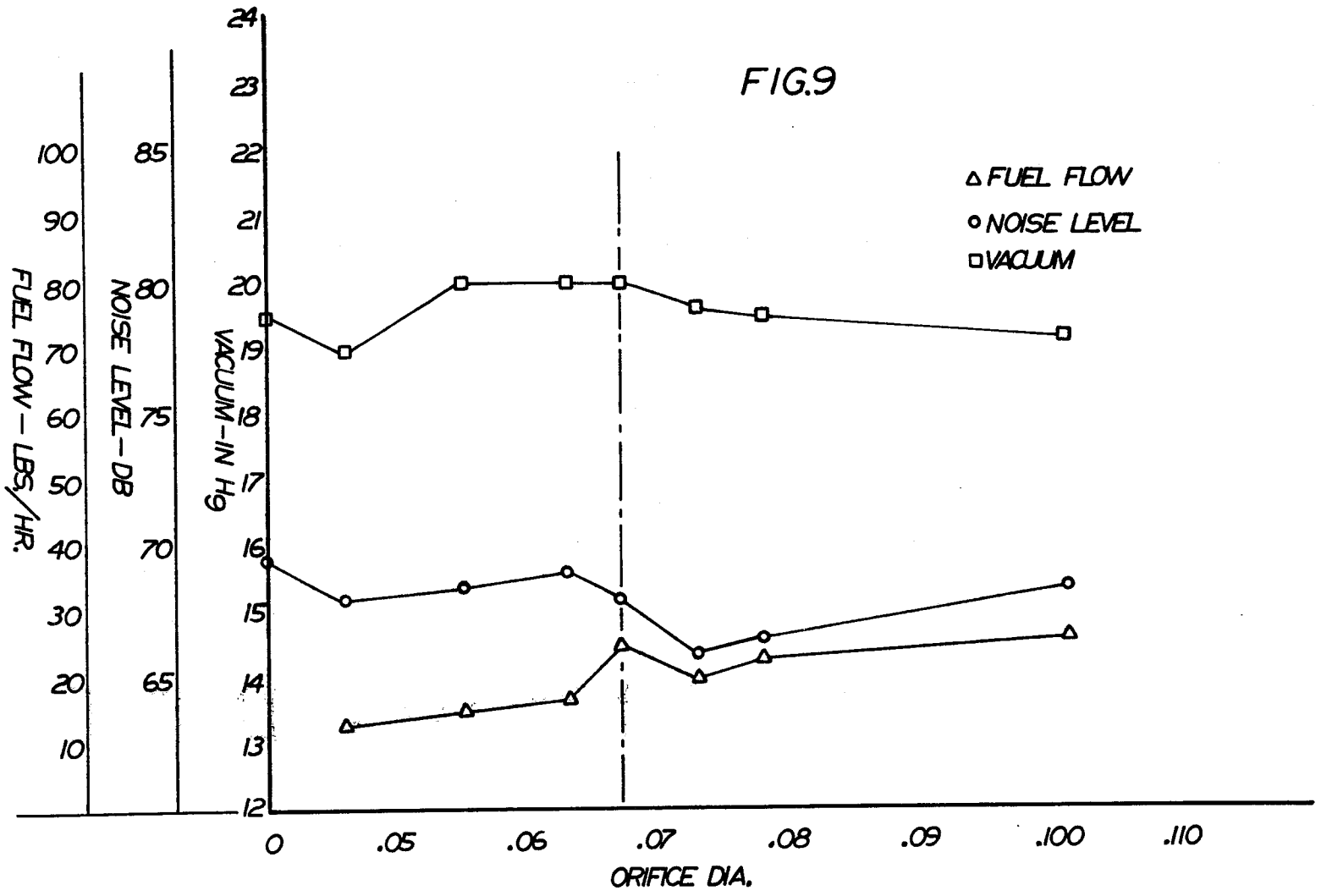

The graph of FIG. 9 is a graph of still another pump having yet a different cam stroke or rise than those of FIGS. 7 and 8, but otherwise the same. From viewing FIG. 9, it is apparent that the best orifice diameter for the pump is 0.067 inches. When the orifice diameter is 0.067 inches, the noise level was quite low while the vacuum and fuel flow rates were at maximum, or relatively close to maximum.

Figure 10:
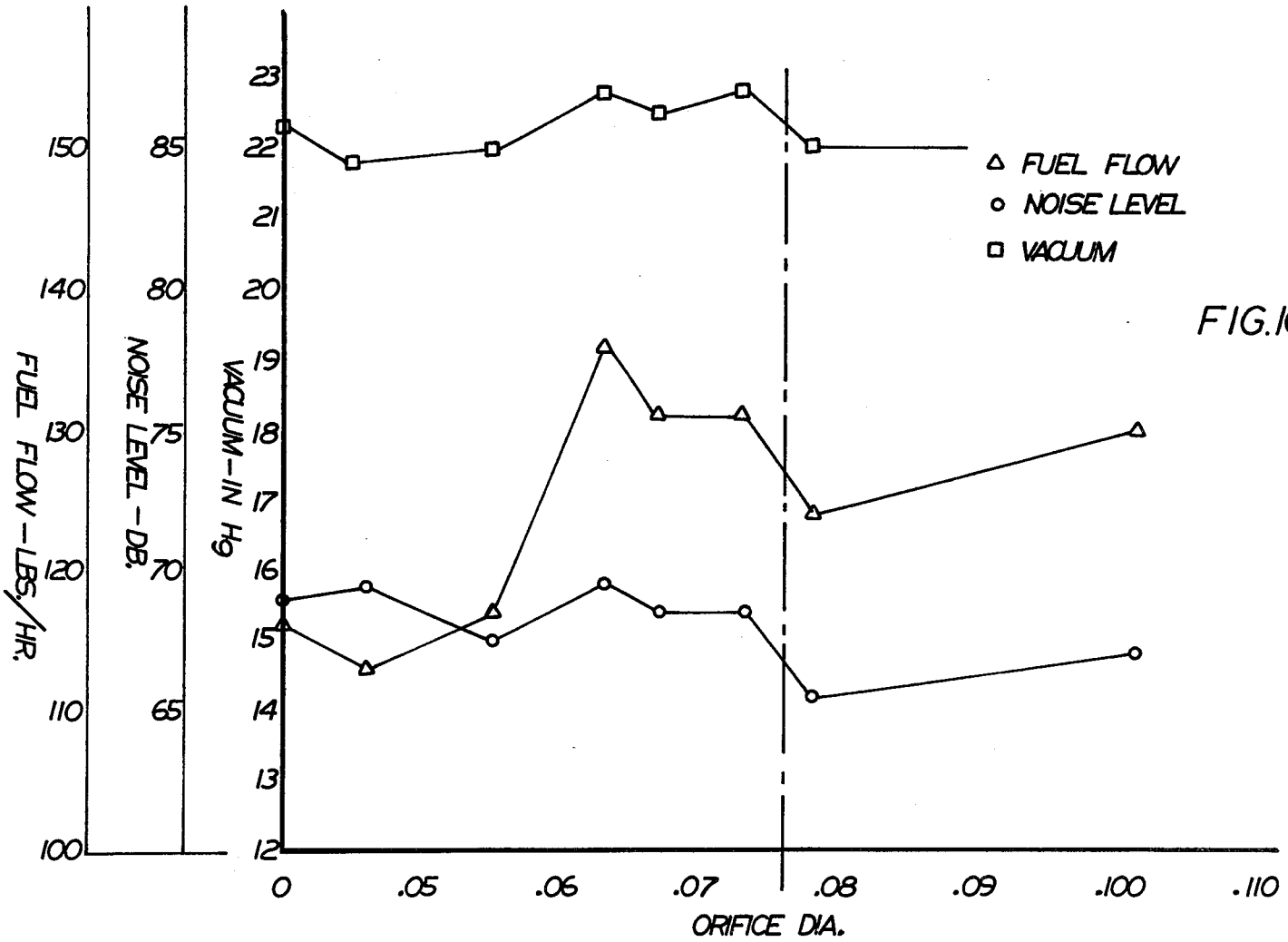

FIG. 10 is a graph of still another pump having another different cam stroke or rise. In the pump depicted by the graph of FIG. 10, the noise level was quite low and almost at a minimum with an orifice diameter of 0.076 inches. Also, with the orifice diameter of 0.076 inches, the fuel flow rate was relatively high as was the vacuum produced at the inlet of the pump.

Figure 11:
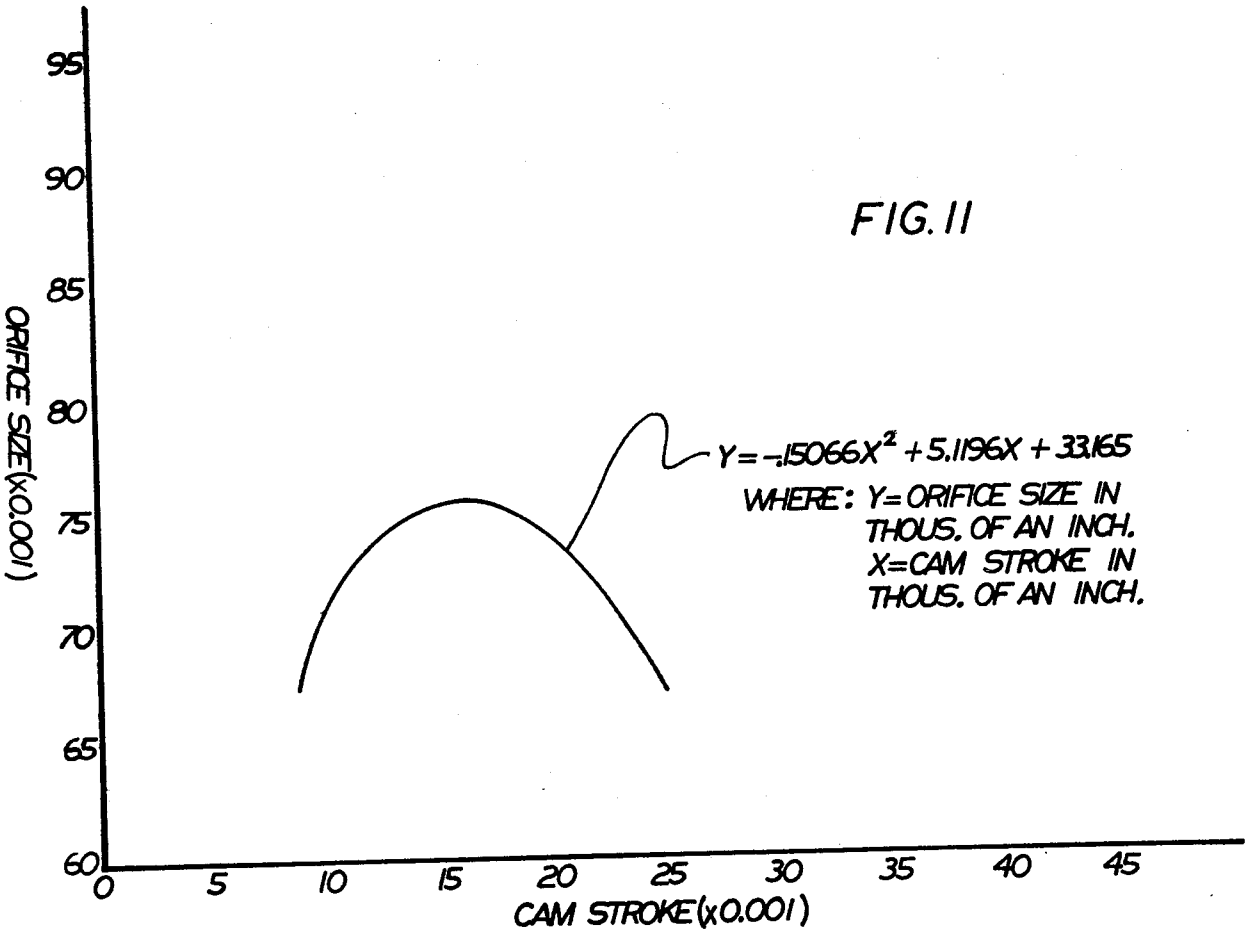
FIG. 11 is a graph illustrating a curve which indicates the relationship of orifice size to cam stroke.

As noted above, the various pumps tested were identical except for cam stroke and orifice sizes. As a result, it was determined that a relationship between cam rise (i.e., the rate of volume change of a pumping pocket) and orifice diameter exists. Accordingly, the best orifice size for each pump was plotted against the cam rise of the pump, (see FIG. 11). These plots provide a generally parabolic curve designated Y in FIG. 11. The curve Y is a curve which approximates the orifice diameter which should be used depending upon the cam stroke or rise in the pump in which the orifice is used. Thus, for example, with a cam stroke of 0.025 inches, an orifice size of 0.067 inches should be chosen. The curve Y produced by the test results can also be defined in equation form. Specifically, the curve can be defined as follows:

$$Y = -0.15066X^2 + 5.1196X + 33.165$$

where:

Y = orifice diameter in 0.001 inches and
X = cam stroke in 0.001 inches.

It should be apparent from the above that applicant has discovered that by sizing the orifices 60, 61 precisely, fuel pump characteristics can be controlled to provide for high discharge fuel flow and high vacuum at the inlet, and yet restrict fluid noises produced in the pump. Accordingly, the orifices, it should be apparent, are a means for restricting fluid noises produced in the pump and without any detrimental effect on discharge rate of the pump and vacuum produced in the inlet of the pump.

What is claimed is:

1. A pump for pumping low viscosity fuels which have a tendency to vaporize, said pump comprising means defining an inlet and an outlet, a cam means defining a pumping chamber bore wall defining at least one inlet arc of increasing radius and at least one outlet arc of decreasing radius, a plurality of slippers defining pumping pockets, means for moving said slippers through said inlet arc in which the pumping pockets defined between adjacent slippers are reducing in pressure so as to draw the low viscosity fuel into the pump and through said outlet arc where the pumping pockets are reducing in volume to force the low viscosity fuel through the outlet of the pump, said means for moving said slippers comprising a slotted rotor, each of said slippers being located in a respective slot in the rotor and being biased radially outwardly of the rotor into engagement with the bore wall, an inlet port communicating with said inlet and said pumping pockets as said pumping pockets move through said inlet arc, an outlet port communicating with said pumping pockets and said outlet as said pumping pockets move through said outlet arc, and means for optimizing fuel output rate, inlet vacuum and noises produced by fluid flow in the pump comprising an orifice of predetermined diameter located in said inlet arc and in communication with said inlet and each pumping pocket at a location radially inwardly of said slippers, said orifice diameter being such that pump noise is restricted and said pump has a relatively high output flow rate and a relatively high inlet vacuum.

2. A slipper pump for pumping low viscosity fuels which have a tendency to vaporize, said pump comprising means defining an inlet and an outlet, a cam means defining a pumping chamber bore wall defining at least one inlet arc of increasing radius and at least one outlet arc of decreasing radius, a plurality of circumferentially spaced slippers defining pumping pockets, means for moving said slippers through said inlet and outlet arcs to effect pumping of fuel, an inlet port communicating with said inlet and said pumping chambers as said pumping pockets move through said inlet arc, an outlet port communicating with said pumping pockets and said outlet as said pumping pockets move through said outlet arc, and an orifice of predetermined size located in said inlet arc and communicating with said inlet and said pumping pockets at a location radially inwardly of said slippers, said orifice being approximately sized in accordance with the equation $Y=-0.15066X^2+5.1196X+33.165$ where Y=the orifice diameter in thousandths of an inch and X=the cam rise of said cam means in thousandths of an inch.

3. A pump for pumping low viscosity fuels which have a tendency to vaporize, said pump comprising means defining an inlet and an outlet, a cam means defining a pumping chamber bore wall defining at least one inlet arc of increasing radius and at least one outlet arc of decreasing radius, a plurality of slippers defining pumping pockets, means for moving said slippers through said inlet arc in which the pumping pockets defined between adjacent slippers are reducing in pressure so as to draw the low viscosity fuel into the pump and through said outlet arc where the pumping pockets are reducing in volume to force the low viscosity fuel through the outlet of the pump, said means for moving said slippers comprising a slotted rotor, each of said slippers being located in a respective slot in the rotor and being biased radially outwardly of the rotor into engagement with the bore wall, an inlet port communicating with said inlet and said pumping pockets as said pumping pockets move through said inlet arc, an outlet port communicating with said pumping pockets and said outlet as said pumping pockets move through said outlet arc, and means for restricting noises produced by fluid flow in the pump comprising an orifice of predetermined diameter located in said inlet arc and in communication with said inlet and each pumping pocket at a location radially inwardly of said slippers, said orifice being circular in cross section and having a diameter falling within the range of 0.067 inches to 0.076 inches.

4. A pump for pumping low viscosity fuels which have a tendency to vaporize, said pump comprising means defining an inlet and an outlet, a cam means defining a pumping chamber bore wall defining at least one inlet arc of increasing radius and at least one outlet arc of decreasing radius, a plurality of slippers defining pumping pockets, means for moving said slippers through said inlet arc in which the pumping pockets defined between adjacent slippers are reducing in pressure so as to draw the low viscosity fuel into the pump and through said outlet arc where the pumping pockets are reducing in volume to force the low viscosity fuel through the outlet of the pump, said means for moving said slippers comprising a slotted rotor, each of said slippers being located in a respective slot in the rotor and being biased radially outwardly of the rotor into engagement with the bore wall, an inlet port communicating with said inlet and said pumping pockets as said pumping pockets move through said inlet arc, an outlet port communicating with said pumping pockets and said outlet as said pumping pockets move through said outlet arc, and means for restricting noises produced by fluid flow in the pump comprising an orifice of predetermined diameter located in said inlet arc and in communication with said inlet and each pumping pocket at a location radially inwardly of said slippers, said inlet port and said orifice being formed in the same member, said inlet comprising a central passage in said member, and said orifice comprising a passage having an axis parallel to the axis of said central passage, said orifice being of a uniform diameter throughout its extent.

5. A pump as defined in claim 4 wherein a further flow passage communicates with said central passage and extends at an acute angle therefrom, and said orifice and said inlet port communicate with said further flow passage.

6. A pump as defined in claim 4 or 5 wherein said pump comprises a two-stroke pump and accordingly includes two inlet ports and two orifices each of identical construction.

7. A pump for pumping low viscosity fuels which have a tendency to vaporize, said pump comprising means defining an inlet and an outlet, a cam means defining a pumping chamber bore wall defining at least one inlet arc of increasing radius and at least one outlet arc of decreasing radius, a plurality of slippers defining pumping pockets, means for moving said slippers through said inlet arc in which the pumping pockets defined between adjacent slippers are reducing in pressure so as to draw the low viscosity fuel into the pump and through said outlet arc where the pumping pockets are reducing in volume to force the low viscosity fuel through the outlet of the pump, said means for moving said slippers comprising a slotted rotor, each of said slippers being located in a respective slot in the rotor and being biased radially outwardly of the rotor into engagement with the bore wall, an inlet port communicating with said inlet and said pumping pockets as said pumping pockets move through said inlet arc, an outlet port communicating with said pumping pockets and said outlet as said pumping pockets move through said outlet arc, and means for restricting noises produced by fluid flow in the pump comprising an orifice of predetermined diameter located in said inlet arc and in communication with said inlet and each pumping pocket at a location radially inwardly of said slippers, said orifice being approximately sized in accordance with the equation $Y=-0.15066X^2+5.1196X+33.165$ where Y=the orifice diameter in thousandths of an inch and X=the cam rise of said cam means in thousandths of an inch.

8. A pump for pumping low viscosity fuels which have a tendency to vaporize, said pump comprising means defining an inlet and an outlet, cam means defining a pumping chamber bore wall defining a pair of diametrically spaced inlet arcs of increasing radius and a pair of diametrically spaced outlet arcs of decreasing radius, a plurality of slippers defining pumping pockets located within said bore wall, means for rotating said slippers through said inlet arc in which the pumping pocket defined between adjacent slippers is reducing in pressure so as to draw the low viscosity fuel into the pump and through said outlet arc where the pumping pockets are reduced in volume to force the low viscosity fuel through the outlet of the pump, a pair of diametrically spaced inlet ports communicating with said inlet and said pumping pockets as said pumping pockets move through said inlet arcs, a pair of diametrically spaced outlet ports communicating with said pumping pockets and said outlet as said pumping pockets move through said outlet arcs, a pair of orifices of predetermined diameter located in said respective inlet arcs and which communicate with said inlet and each pumping pocket at a location radially inwardly of said slippers, said inlet comprising a centrally located passage which is coaxial with the axis of rotation of said slippers, and means defining a pair of fluid passages, each of which communicates with said centrally located passage and with one of said orifices and inlet ports, said further passages having an axis extending at an acute angle to the axis of said centrally located passage, and said orifices each having an axis extending parallel to the axis of said centrally located passage.

9. A pump as defined in claim 8 wherein said inlet ports each comprises two inlet port portions, one of which portions extends arcuately in the direction of the slipper rotation and the other of which extends generally radially and communicates with said arcuately extending portions.

10. A pump as defined in claim 8 wherein each of said orifices are circular in cross-section and have identical diameters falling within the range of 0.067 inches to 0.076 inches.

11. A pump as defined in claim 8 wherein each of said orifices is approximately sized in accordance with the equation $Y=-0.15066X^2+5.1196X+33.165$, where Y=the orifice diameter in thousandths of an inch and X=the cam rise of said cam means in thousandths of an inch.

* * * * *

UNITED STATES PATENT AND TRADEMARK OFFICE

CERTIFICATE OF CORRECTION

PATENT NO. : 4,259,044

DATED : March 31, 1981

INVENTOR(S) : Gilbert H. Drutchas et al.

It is certified that error appears in the above-identified patent and that said Letters Patent are hereby corrected as shown below:

Column 7, line 35, change "diameter" to --size--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*